US006722025B2

(12) United States Patent
Bohmer et al.

(10) Patent No.: US 6,722,025 B2
(45) Date of Patent: Apr. 20, 2004

(54) METHOD FOR ADJUSTING AN ELECTRICAL LENGTH OF A COAXIAL CABLE AND PLUG CONNECTOR

(75) Inventors: Peter Siegfried Bohmer, Aue (DE); Reiner Richter, Dresden (DE)

(73) Assignee: Spinner GmbH Elektrotechnische Fabrik, München (DE)

( * ) Notice: Subject to any disclaimer, the term of this patent is extended or adjusted under 35 U.S.C. 154(b) by 0 days.

(21) Appl. No.: 10/229,856

(22) Filed: Aug. 28, 2002

(65) Prior Publication Data

US 2003/0003801 A1 Jan. 2, 2003

Related U.S. Application Data

(62) Division of application No. 09/932,675, filed on Aug. 17, 2001, now Pat. No. 6,575,785.

(30) Foreign Application Priority Data

Aug. 19, 2000 (DE) ..... 100 40 743

(51) Int. Cl.[7] ..... H01B 13/20; H01R 9/05

(52) U.S. Cl. ..... 29/828; 29/592.1; 29/593; 29/857; 29/868; 439/578; 439/642; 439/675

(58) Field of Search ..... 29/825, 592.1, 29/593, 857, 868, 828; 439/578, 675, 642, 320

(56) References Cited

U.S. PATENT DOCUMENTS

| | | | | |
|---|---|---|---|---|
| 4,741,702 A | | 5/1988 | Yasumoto | |
| 4,824,399 A | * | 4/1989 | Bogar et al. | 439/578 |
| 5,232,377 A | * | 8/1993 | Leibfried, Jr. | 439/320 |
| 5,269,701 A | * | 12/1993 | Leibfried, Jr. | 439/578 |
| 5,746,623 A | * | 5/1998 | Fuchs et al. | 439/578 |
| 5,830,009 A | * | 11/1998 | Tettinger | 439/578 |

* cited by examiner

*Primary Examiner*—Carl J. Arbes
*Assistant Examiner*—Tai V Nguyen
(74) *Attorney, Agent, or Firm*—Henry M. Feiereisen

(57) ABSTRACT

A method for adjusting an electrical length of a coaxial cable and a plug connector with an adjustable length that facilitates the adjustment of the electrical length of the cable are disclosed. With the method, both ends of the coaxial cable are terminated with a respective coaxial plug connector wherein at least one of the plug connectors has an adjustable length. One of the coaxial plug connectors is connected with a phase measurement device, and the other coaxial plug connector having the adjustable length is electrically shorted with a short-circuit plug. A pressing force is applied in an axial direction between the short-circuit plug and an outer conductor of the coaxial plug connector, until the phase measurement device indicates that the electrical length has reached a predetermined value.

3 Claims, 2 Drawing Sheets

METHOD FOR ADJUSTING AN ELECTRICAL LENGTH OF A COAXIAL CABLE AND PLUG CONNECTOR

CROSS-REFERENCES TO RELATED APPLICATIONS

This application is a division of prior filed application Application Ser. No. 09/932,675, filed Aug. 17, 2001, now U.S. Pat. No. 6,575,785.

This application claims the priority of German Patent Application Ser. No. 100 40 743.9, filed Aug. 19, 2000, the subject matter of which is incorporated herein by reference.

FIELD OF THE INVENTION

The invention relates to a method for adjusting the electrical length of a coaxial cable which has coaxial plug connectors on both cable ends. At least one of the plug connectors has an adjustable length.

BACKGROUND OF THE INVENTION

Coaxial cables which have plug connectors on both ends are typically referred to as preformed cables, sometimes also as jumper cables. The specified electrical length of such preformed cables frequently has a rather tight tolerance. Although the electrical length of the preformed cable is related to its mechanical length, the predetermined nominal value of the electrical length can not be attained simply by cutting the cable to the corresponding mechanical length, even when the electrical length of the two plug connectors is taken into consideration. This is mainly due to the fact that the electrical length of a cable may vary over the mechanical length (due to small deviations of the dielectric constant and/or the characteristic impedance). Moreover, the tolerances added by cutting of the cable to a nominal length, by preparing the cable ends for installation of the plug connectors and finally the linear tolerances of the plug connectors themselves may invariably be greater than the tight tolerances required for the electrical length of the preformed cable. For this reason, the preformed cable is cut with sufficient excess length and its electrical length is adjusted by measuring the phase angle that corresponds to the electrical length with a phase measurement device, typically a vector network analyzer. This measurement is performed while changing the mechanical length of at least one of the plug connectors until the actual value of the phase angle is equal to be preset nominal value. It is known to use conventional plug connectors with an inner conductor having several sliding contacts that move telescopically inside of one another. The outer conductor is also made of several multi-part threaded sleeves that are screwed into each other. The telescopically moveable inner conductor elements are received in several insulator support members which center and guide the inner conductor of the connector. The threaded sleeves that form the outer conductor of the connector, are adjusted and secured in their final position, typically with lock nuts. The fabrication of preformed coaxial cables with a defined electrical length therefore necessitates the use of complex plug connectors having a large number of precision-machined parts which take-up space and require time-consuming manual adjustment, for example, by rotating the threaded sleeves that form a part of the outer conductor of the connector. The threaded sleeves must also be secured in the adjusted position.

It is therefore desirable to provide a simple and small plug connector with a low parts count, whose electrical length can be easily adjusted after installation on a coaxial cable.

SUMMARY OF THE INVENTION

According to one aspect of the present invention, a coaxial plug connector with an adjustable length includes an outer conductor located on the cable-side and adapted to be connected to an outer conductor of the cable. The connection-side outer conductor of the connector is received in the outer conductor located on the cable-side by a press fit and can be displaced in the axial direction by a distance (e). The inner conductor of the connector can be displaced in an insulator support member by at least the adjustment distance (e) of the connection-side outer conductor of the connector.

The plug connector includes has a low parts count and can be manufactured easily and inexpensively. The preformed cable can be shortened by controllably pressing the connection-side outer conductor of the connector into the cable-side outer conductor of the connector in an axial direction. The cable is manufactured with a sufficient positive tolerance relative to the nominal value of the electrical length.

Preferably, the cable-side outer conductor of the connector is adapted to be soldered to or crimped onto the outer conductor of the cable. These are inherently known connection methods which provide preformed cables with tight tolerances with the typically required high intermodulation separation.

Advantageously, the outer periphery of the cable-side outer conductor of the connector has a profile that is complementary to that of a thrust block. This arrangement provides the necessary axial support when the connection-side outer conductor of the connector is subsequently pressed into the cable-side outer conductor of the connector.

The outer periphery of the connection-side outer conductor of the connector can have an annular shoulder that limits its maximum adjustment distance.

Advantageously, the inner conductor of the connector can be formed in one-piece and adapted to be soldered to the inner conductor of the cable. This plug connector can be manufactured more cost-effectively than a plug connector with a conventional telescopic plug inner conductor which is supported by insulator support elements in several places.

According to another aspect of the invention, a method is provided for adjusting the electrical length of a coaxial cable with a respective coaxial plug connector on both ends. At least one of the plug connectors has a connection-side outer conductor that is received in the outer conductor located on the cable-side by a press fit and can be displaced in the axial direction by a distance (e). The inner conductor of the connector can be displaced in the insulator support member by at least the adjustment distance (e) of the connection-side outer conductor of the connector. The method includes the following steps:

- connecting a plug connector with a phase measurement device
- shorting the plug connector having the adjustable length with a short-circuit plug
- clamping the plug connector having the adjustable length and the short-circuit plug in a pressing device having a piston acting in an axial direction on the short-circuit plug, with the cable-side outer conductor of the connector of the plug connector being supported against a thrust block of the pressing device
- shortening the electrical length of the cable by operating the pressing device until the electrical length reaches a preset nominal value as measured with the phase measurement device.

According to one embodiment of the method, the pressing force is measured during the pressing operation, preferably as a function of the distance traveled by the piston. A check is performed to determine if the measurement value is greater than a minimum value and smaller than a maximum value. The pressing force can be measured either by using a press equipped with a force/distance measurement device, or by placing a force measurement device between the piston of the press and the short-circuit plug. If the measured pressing force is outside the tolerance limits defined by the minimum value and the maximum value, respectively, then the respective cable is discarded as scrap, because the plug connector may not have sufficient mechanical strength If the pressing force is too small, and the plug connector can be mechanically damaged if the pressing force is too large.

Further features and advantages of the present invention will be apparent from the following description of preferred embodiments illustrated in the drawings and from the claims.

BRIEF DESCRIPTION OF THE DRAWING

The following Figures depict certain illustrative embodiments of the invention in which like reference numerals refer to like elements. These depicted embodiments are to be understood as illustrative of the invention and not as limiting in any way.

DETAILED DESCRIPTION OF PREFERRED EMBODIMENTS

Figure 1:
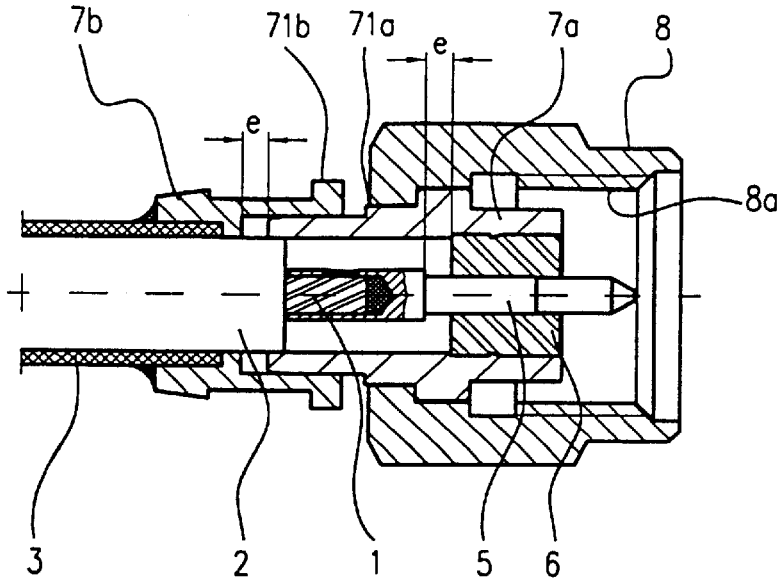
FIG. 1 shows a longitudinal cross-section of the plug connector, before adjustment, FIG. 2. shows the plug connector of FIG. 1 with the adjustment distance fully utilized.

FIG. 1 shows a coaxial plug connector which has an adjustable length and is installed on one end of a coaxial cable. The cable is constructed in the usual manner and has a inner conductor of the cable 1, a dielectric 2 and a the cable outer conductor 3, which in this case is a braided outer conductor 3. The plug connector includes an inner conductor 5 which is moveably disposed on an isolator support member 6. A conventional connecting sleeve 8 with an indicated inner thread 8*a* is loosely and rotatably disposed on the outer conductor 7*a* of the connector. The cable-side end of the outer conductor 7*a* of the connector is received with a press fit in an outer conductor 7*b* of the connector which is soldered with its end facing the cable-side to the braided outer conductor 3. In the position indicated in FIG. 1 and before the adjustment process described below, the outer conductor 7*a* of the connector can be pressed further into the cable-side outer conductor 7*b* of the connector by a maximum distance "e" which indicates the maximum available adjustment distance. The inner conductor of the connector 5 which has the same diameter as the region of the isolator support member 6, extends by at least the same adjustment distance "e" in the direction of the cable.

Figure 2:
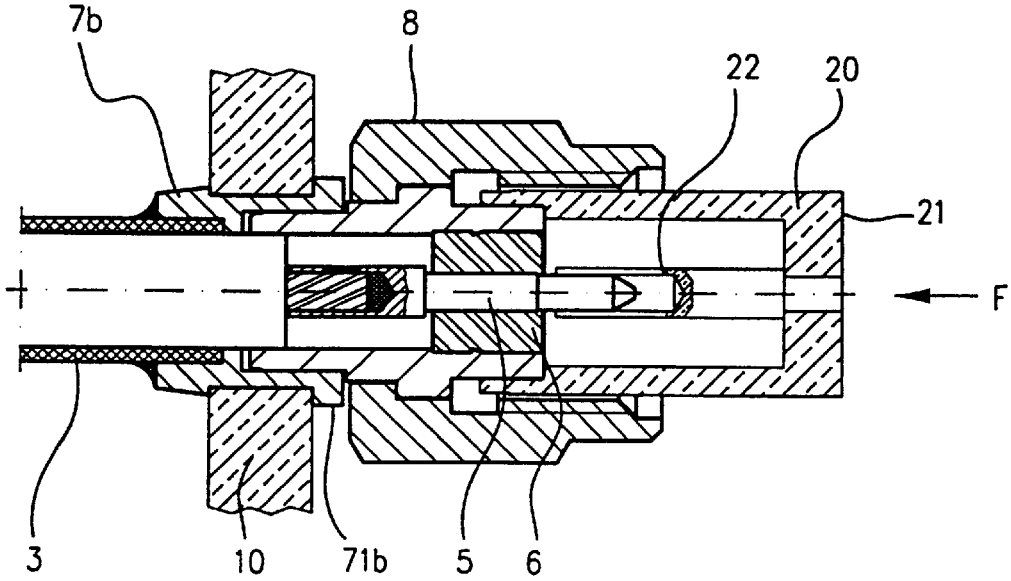

An annular shoulder 71*b* is disposed on the outer periphery of the cable-side outer conductor 7*b* of the connector. During the adjustment, this annular shoulder supports the outer conductor 7*b* of the connector against a thrust block 10. FIG. 2 shows the relative position of the elements of the plug connector after an adjustment, where the maximum available adjustment distance "e" is exhausted. An annular collar 71*a* of the outer conductor 7*a* of the connector herein contacts the annular shoulder 71*b* of the outer conductor 7*b* of the connector. For this purpose, a short-circuit plug 20 with a known electrical length is placed on the connection side of the plug connector. A pressing force F exerts pressure on the bottom 21 of the short-circuit plug 20, which pushes the outer conductor 7*a* of the connector into the outer conductor 7*b* of the connector up to a limit stop. The inner conductor of the cable 1 has displaced the inner conductor of the connector 5 in the isolator support member 6 by the same distance towards the connection side. The inner conductor of the connector 5 which is shown on the connection side as an exemplary pin, projects over the connection-side end face of the isolator support member by a distance "e" that is equal to the adjustment distance "e". However, the inner conductor of the connector 5 remains within the tolerance determined by the respective plug standard. This is insignificant in this case, because the electrical separation and reference plane of the plug connector coincides with the connection-side end face of the outer conductor 7*a* of the connector. In other words, it is immaterial how far the pin-shaped inner conductor of the connector projects into the female inner conductor of the abutting plug connector that is formed as a coupler. The same applies for the female inner conductor 22 of the short-circuit plug 20.

Figure 3:
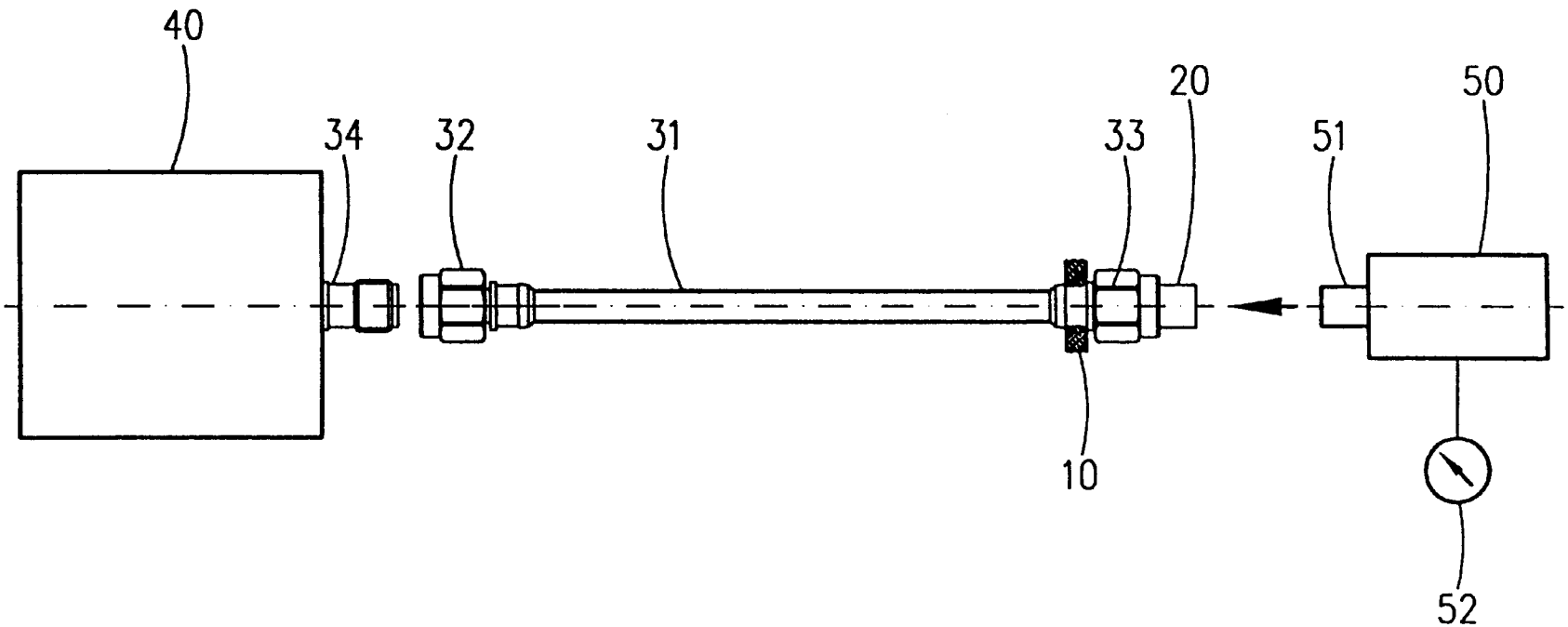
FIG. 3 illustrates schematically the adjustment of the electrical length of the cable.

FIG. 3 shows a coaxial cable 71 which has respective plug connectors 32 and 33 located on both ends. At least one of the plug connectors 32 and 33, in this case the plug connector 33, has an adjustable length, as described above with reference to FIGS. 1 and 2. The plug connector 32 and the applied short-circuit plug 20 are received in a thrust block 10. The plug connector 32 disposed on the other end of the preformed cable 32 is connected via a mating connector 34 to a network analyzer 40. The network analyzer 40 displays the phase angle representing the preset nominal value of the respective preformed cable as well as the measured value, which is initially greater than the nominal value. The piston 51 of a press 50 presses via the short-circuit plug 20 the connection-side outer conductor 7*a* of the connector into the cable-side outer conductor 7*b* of the connector, until the actual value of the phase angle attained by shortening the preformed cable electrically (which is equivalent to shortening the cable mechanically) is equal to the nominal value. This operation can be performed manually or automatically. The press 50 has a display 52 for displaying the actual value of the pressing force which, for the reasons already discussed above, has to remain within a predetermined tolerance range. If the available adjustment distance of the plug connector 33 is insufficient and if the plug connector 32 is also constructed as shown in FIGS. 1 and 2, then the electrical length of the cable can be further adjusted by interchanging the roles of the plug connectors 32 and 33. The required adjustment distance is typically only several tenths of a millimeter and rarely exceeds 1 or 2 mm, since the operating frequencies of phase-compensated cables are generally in the GHz range.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. Method for adjusting an electrical length of a coaxial cable, wherein both ends of the coaxial cable are terminated with a respective coaxial plug connector and with at least one of the plug connectors has an adjustable length, the method comprising:

connecting one of the coaxial plug connectors with a phase measurement device;

electrically shorting the other coaxial plug connector having the adjustable length with a short-circuit plug; and applying a pressing force in an axial direction between the short-circuit plug and an outer conductor of the coaxial plug connector facing the coaxial cable for the purpose of shortening the electrical length of the coaxial cable, until the phase measurement device indicates that the electrical length has reached a predetermined value.

2. The method of claim 1, wherein the pressing force is measured while the pressing force is applied, and wherein the measured value of the pressing force is checked so as to be greater than a minimum value and smaller than a maximum value.

3. The method of claim 2, wherein the pressing force is measured as a function of the electrical length of the coaxial cable.

* * * * *